US008512930B2

(12) United States Patent
Chatow et al.

(10) Patent No.: US 8,512,930 B2
(45) Date of Patent: Aug. 20, 2013

(54) PRINTING OF IMAGES WITH SELECTIVE GLOSS AND TONERS THEREFORE

(75) Inventors: Ehud Chatow, Raanana (IL); Haim Victor Gal, Rehovot (IL); Galia Golodetz, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1722 days.

(21) Appl. No.: 10/585,681

(22) PCT Filed: Dec. 8, 2003

(86) PCT No.: PCT/IL03/01035

§ 371 (c)(1),
(2), (4) Date: Jul. 10, 2006

(87) PCT Pub. No.: WO2005/054959

PCT Pub. Date: Jun. 16, 2005

(65) Prior Publication Data

US 2007/0105034 A1 May 10, 2007

(51) Int. Cl.
*G03G 15/10* (2006.01)

(52) U.S. Cl.
USPC ..... 430/114; 430/115; 430/117.1

(58) Field of Classification Search
USPC ..... 430/114, 115, 117.1
See application file for complete search history.

(56) References Cited

U.S. PATENT DOCUMENTS

| | | | | |
|---|---|---|---|---|
| 6,162,573 | A * | 12/2000 | Grande et al. | 430/137.18 |
| 6,210,852 | B1 * | 4/2001 | Nakamura | 430/108.2 |
| 6,562,541 | B2 * | 5/2003 | Vanbesien et al. | 430/137.14 |
| 2004/0115550 | A1 * | 6/2004 | Sugiura et al. | 430/109.4 |

FOREIGN PATENT DOCUMENTS

| | | |
|---|---|---|
| CA | 989683 | 5/1976 |
| JP | 5232840 | 9/1993 |
| JP | 5265287 | 10/1993 |
| JP | 2000235284 | 8/2000 |
| JP | 2003091092 | 3/2003 |

OTHER PUBLICATIONS

International Search Report PCT/IL03/01035.
Patent Cooperation Treaty PCT Written Opinion.

* cited by examiner

*Primary Examiner* — Mark F Huff
*Assistant Examiner* — Rachel Zhang

(57) ABSTRACT

A matte liquid toner suitable for use in a liquid toner printer, comprising a carrier liquid, toner particles comprising a resin and substantially uncolored additive particles of average diameter between 1 and 20 micrometers dispersed in the resin.

20 Claims, 2 Drawing Sheets

PRINTING OF IMAGES WITH SELECTIVE GLOSS AND TONERS THEREFORE

FIELD OF THE INVENTION

The field of the invention is printing images.

BACKGROUND OF THE INVENTION

As prints produced by laser printers approach the image quality of traditional photographic printing, they have taken over an increasing share of the photographic print market. Traditional photographic prints come in different degrees of glossiness, typically glossy, semi-gloss and matte, each using a different grade of paper.

Using different grades of paper to achieve different degrees of glossiness in a laser printer is not so simple, since toners with desirable properties, for example durability, may themselves produce a glossy surface, even on matte paper (or vice-versa). PCT publication WO 01/56806 the disclosure of which is incorporated herein by reference, describes a way to overcome that problem by using a layer of toner that is thin compared to the roughness of the paper or other printing media, so that it acquires the same glossiness as the underlying paper. In any case, inexpensive printers do not generally have several input trays which the printer can automatically choose between. So making prints with different degrees of glossiness by using different grades of paper would require keeping two or three different grades of paper on hand, and hand or machinefeeding the desired paper for each print.

Van Goethem et al, in U.S. Pat. No. 6,101,345, describe varying the glossiness of images printed by a laser printer by varying the fusing temperature, or varying the speed at which the paper passes through the fuser.

Bengston, in U.S. Pat. No. 6,438,336, describes achieving multiple gloss levels on a single image, for example by passing the paper through the printer one time for each gloss level, and varying the fusing temperature on each pass. The disclosures of both these patents are incorporated herein by reference, Several patents describe ways to achieve uniform levels of gloss on an image, when the toner is glossy, but some parts of the image are devoid of toner. Lamination is one option, but is not practical on inexpensive printers. Another option, described by WO 01/56806, is to apply a transparent toner, with the same glossiness as the actual toner, to those parts of the image that are lacking toner. Alternatively, such a glossy coating can be applied to the whole page as an undercoat, before printing the image, or as an overcoat. Such glossy overcoats and undercoats are useful for making the entire image uniformly glossy, whether or not the toner is glossy. But they are not useful if a uniform matte image is desired, and the toner is glossy and/or the paper is glossy.

SUMMARY OF THE INVENTION

An aspect of an embodiment of the invention concerns toners which are essentially colorless, but which produce a matte finish when printed over another toner or ink or a printing media which would otherwise have a glossy finish. Optionally, this colorless "toner" is suitable for use in existing printers, such as liquid toner laser printers, and the like. Such printers often use four colors of toner, cyan, yellow, magenta and black (called "CYMK"), for printing color images, but may have one or two additional reservoirs available for additional toners or overcoats.

If the matte "toner" is used in one of these additional reservoirs, then the printer can print either matte or glossy prints, using the same printing media for both, even if the printing media or the colored toner would have a glossy finish themselves, for example because the paper on which the image is printed is glossy and the toner printing is thin.

In the case of a digital printer, the choice of matte or glossy finish is optionally entirely under the control of software, which specifies whether or not the image is overprinted with the colorless matte toner. The matte toner is simply placed in one of the reservoirs, and the desired options are added to the software controlling the printer. Furthermore, by applying the matte toner only to some pixels, many different degrees of intermediate (semi-gloss) finish can be achieved, and different regions of the image can be given different degrees of gloss, for example to highlight certain parts of the image.

An even greater range of glossiness is optionally achieved if a colorless toner that provides an extra glossy finish, glossier than the colored toner and printing media would have by themselves, is printed on part of the image. These effects are also optionally achieved in black and white images, using only black toner, a colorless matte toner, and optionally a colorless glossy toner.

Optionally, instead of or in addition to applying the colorless matte toner as an overcoat on top of the colored toner, the colorless matte toner is applied as an undercoat, directly on the printing media, and the colored toner is applied over the matte toner. If the colored toner is applied in a thin enough layer, then the gloss characteristics of the colored toner surface will be similar to the gloss characteristics of the undercoat. This method also makes it possible to print both matte and glossy prints on a glossy printing media, depending on whether or not the matte undercoat is applied.

Another aspect of an embodiment of the invention concerns a liquid toner, suitable for use in a liquid toner laser printer for example, which comprises toner particles and, dispersed within the toner particles, additive particles optionally larger than a wavelength of visible light which do not melt or solvate during printing, and which are not completely crushed during printing. The additive particles either comprise more than 5% and up to 40% or more, by weight of the toner particles, or have diameter greater than 5 micrometers, or both. When printed on a printing media, the toner produces a matte finish, because the additive particles produce a surface that is optically rough. Optionally the toner is substantially colorless. The toner can be used in liquid toner printers, for example, as described above.

There is thus provided, in accordance with an embodiment of the invention, a matte liquid toner suitable for use in a liquid toner printer, comprising:

a) a carrier liquid;

b) toner particles comprising a resin; and c) substantially uncolored additive particles of average diameter between 1 and 20 micrometers dispersed in the resin.

There is further provided, in accordance with an embodiment of the invention, a matte liquid toner suitable for use in a liquid toner printer, comprising:

a) a carrier liquid;

b) toner particles comprising a resin; and c) additive particles of average diameter between 1 and 20 micrometers dispersed in the resin, comprising at least 5% by weight of the toner particles.

Optionally, the additive particles make up between 5% and 10%, 10% and 20%, 20% and 40% and more than 40% by weight of the toner particles.

In an embodiment of the invention the toner is substantially colorless.

Optionally, the average diameter of the additive particles is between 1 and 3 micrometers, 3 and 8 micrometers, 8 and 15 micrometers or 15 and 20 micrometers.

Optionally, the resin comprises at least one thermoplastic resin.

Optionally, at least one of the at least one thermoplastic resins has a melt flow index less than or equal to 100, optionally less than 35.

Optionally, a resin in the toner particles solvates and is plasticized by the carrier liquid.

Optionally, the additive particles comprise one or more of PTFE (teflon), PTFE wax, and polyethylene wax, cross-linked poly-methyl-methacrylate, cross-linked poly-methyl-butylacrylate, and cross-linked poly-acryl-acrylate.

In an embodiment of the invention, the toner particles comprise a first resin, and the additive particles comprise a second resin that is incompatible with the first resin.

There is further provided, in accordance with an embodiment of the invention, a method of printing an at least partially matte image, on a printing media, the method comprising:

a) printing an image on the printing media, which image has a first gloss; and b) printing a layer of a matte toner that reduces the glossiness of the image on at least a portion of the glossy part of the image, thereby reducing the glossiness of said portion.

Optionally, printing the layer of matte toner comprises printing over the image. Optionally, printing the layer of matte toner comprises printing under the image.

In an embodiment of the invention, the matte toner is not printed on the entire image, thereby highlighting part of the image by leaving said part of the image glossier than the portion of the image where the matte toner is printed.

In an embodiment of the invention, the method includes printing a layer of an extra glossy toner that increases the gloss of the image on at least a portion of the part of the image not printed with matte toner.

In an embodiment of the invention, the method includes printing a plurality of images with at least two different degrees of glossiness selectively applied to different images, comprising:

printing a layer of a matte toner on images selected to have a lower degree of glossiness, thereby reducing the glossiness of said images to a second lower degree of glossiness.

Optionally, the method includes printing a layer of an extra glossy toner on images selected to have a greater degree of glossiness.

Optionally, each image has substantially uniform glossiness.

Optionally, the plurality of images are printed on a printing media having a same glossiness.

In an embodiment of the invention, the method includes printing a layer of matte toner comprises printing the layer using different manners to obtain different degrees of glossiness.

Optionally, printing matte toner in different manners comprises printing matte toner covering different proportions of an area being printed.

Optionally, printing matte toner in different manners comprises printing different numbers of layers of matte toner.

In an embodiment of the invention, the matte toner comprises additive particles, and when the toner is printed on a printing media, the presence of the additive particles causes the glossiness of the surface of the printing media to be less than 90%, optionally less than 70%, 50% or 30% of the glossiness that the printed surface would have without the additive particles.

Optionally, the layer of matte toner is printed using a matte toner according to the invention.

Optionally, the additive particles do not melt during printing.

There is further provided, in accordance with an embodiment of the invention, a printer for printing both matte and glossy images on a same grade of printing media, comprising:

a) at least one reservoir holding colored toner;

b) a reservoir holding a matte toner; and c) a printing engine which applies toner from at least one of the at least one colored toner reservoirs to the printing media, thereby producing the images from the colored toner, and selectively applies the matte toner to some of said printing media, thereby making some of the images matte images.

Optionally, the matte toner is the matte toner according to the invention.

Optionally, the printer includes a reservoir holding an extra glossy toner, wherein the printing engine also selectively applies the extra glossy toner to some of the printing media, thereby producing the glossy images.

Optionally, the printing engine is configured to selectively apply the matte toner to only one portion of the printing media, thereby producing images that have different degrees of glossiness in different areas thereof.

Optionally, the printing engine is configured to selectively apply toner so that the image has uniform glossiness.

Optionally, the printer comprises a controller which controls the selective application of the matte toner to the printing media, thereby controlling the glossiness of at least a portion of each image.

Optionally, the print engine selectively applies the matte toner in different manners to produce different degrees of glossiness.

Optionally, the image comprises a plurality of pixels, and the print engine applies the matte toner to different fractions of the pixels to produce different degrees of glossiness.

Optionally, the print engine applies the matte toner to at least some of the printing media more than once, and applies different numbers of layers of the matte toner to produce different degrees of glossiness.

BRIEF DESCRIPTION OF THE DRAWINGS

Exemplary embodiments of the invention are described in the following sections with reference to the drawings, which are generally not to scale.

DETAILED DESCRIPTION OF EXEMPLARY EMBODIMENTS

Figure 1A:
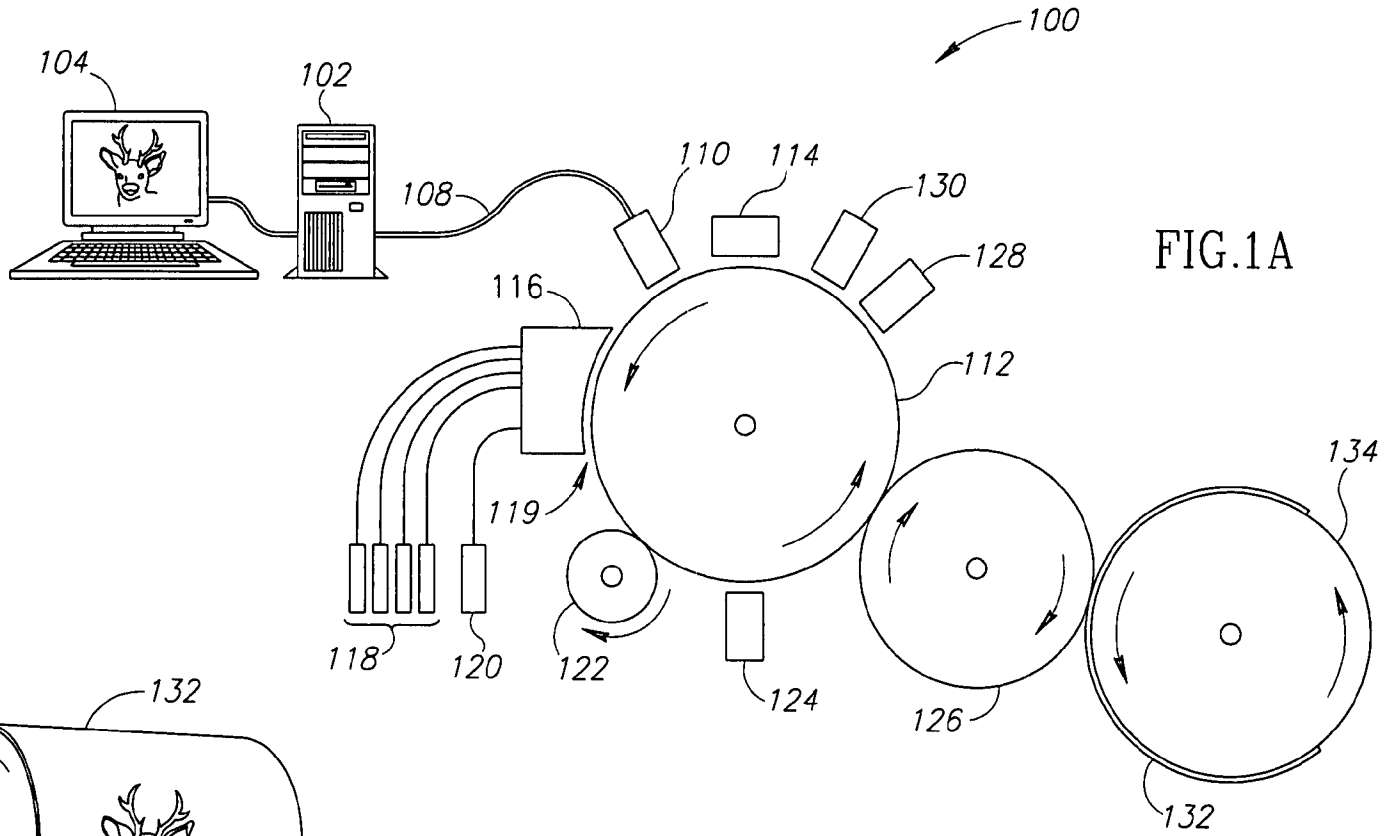
FIG. 1A is a schematic side view showing a printer and printing media in one stage of the printing process, according to an exemplary embodiment of the invention.

FIG. 1A shows a laser printer 100, used for printing images with both matte and glossy finishes, including images with both matte and glossy regions. The process comprises printing an image on a printing media using a conventional toner, and printing an overlaid image with a colorless matte toner. Although the first part of the process is similar to the process used in a conventional liquid toner laser printer, it will be described in some detail so that the second part of the process may be compared to the first part, and better understood. Since the image forming and toning processes themselves are conventional, they are not described in detail. In general, the apparatus can be, for example, any liquid toner printer produced by Hewlett Packard, such as the hp Indigo Press 1000, the hp Indigo Press 3000, or the hp Indigo w3200, or other liquid toner printers known in the art.

Figure 2:
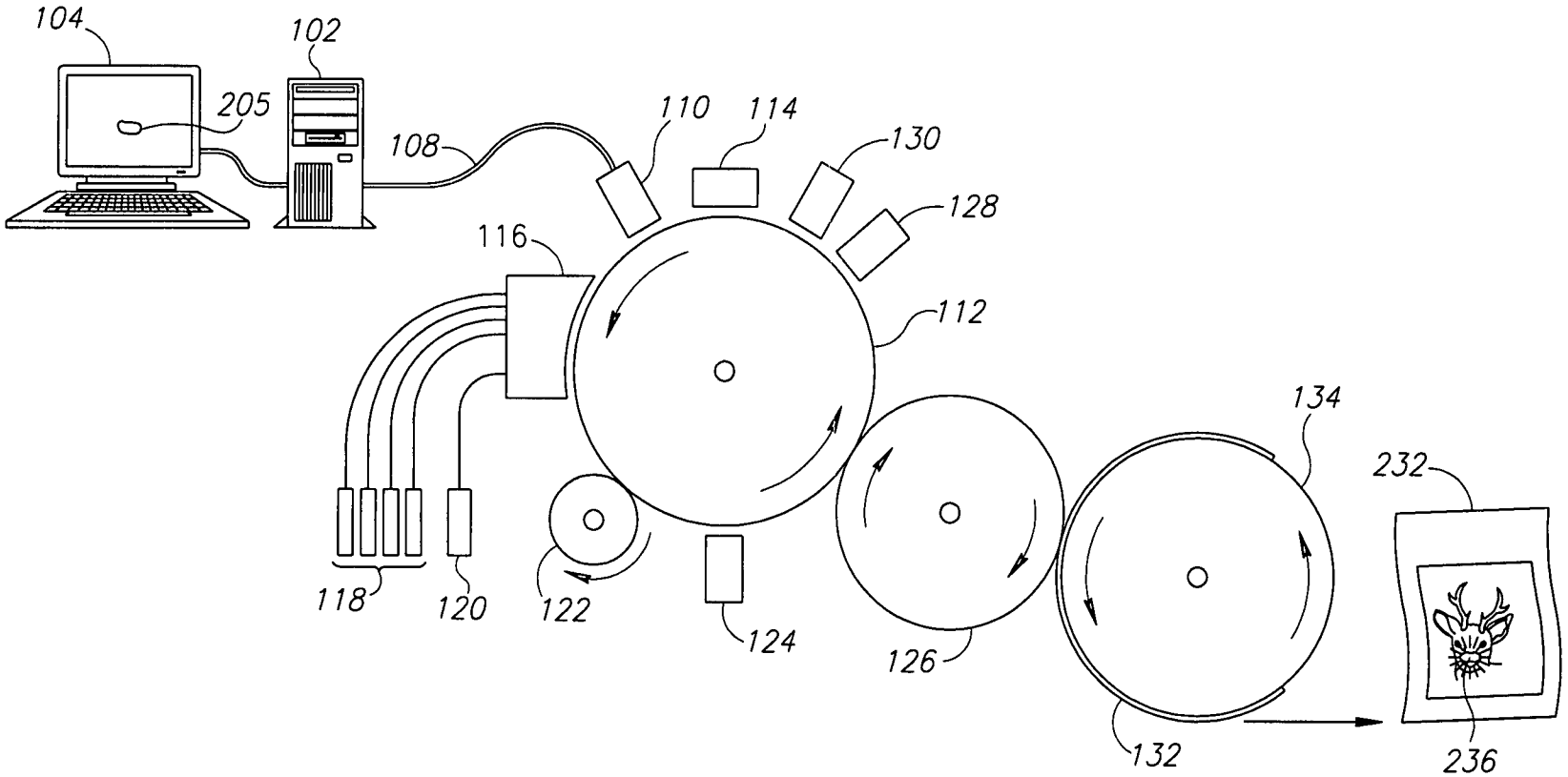
FIG. 2 is a schematic side view showing the printer and printing media shown in FIG. 1A, at a later stage of the printing process, and a perspective view of the printing media after the printing is completed.

A computer 102 generates or acquires an image file, which is shown displayed on a monitor 104. There need not be a monitor, but monitor 104 is shown in FIGS. 1A and 2 in order to make it easier to understand this embodiment of the invention. Computer 102 sends a signal through cable 108 to laser 110, which scans the surface of photosensitive cylinder 112 as the cylinder rotates, illuminating some parts of the surface and not illuminating other parts, according to signal 106. A charger 114 charges the surface of the photosensitive cylinder before it reaches laser 110, and the beam of laser 110 discharges those parts of the cylinder surface which it scans while the laser is turned on, while the charge remains on the other parts of the cylinder surface. After passing the laser, the surface of cylinder 112 has a charge distribution which corresponds to the image displayed on monitor 104, or, in the case of a color image, to one color separation of the image.

After passing laser 110, the surface of cylinder 112 passes development station 116. Toner from one of four colored toner reservoirs 118 is drawn into development station 116, and fills a gap 119 between the development station and the surface of cylinder 112. A voltage is optionally applied to the surface of development station 116 facing the gap. Depending on the development process that is used, toner is drawn to either the charged or the uncharged regions of the surface of cylinder 112, producing a visible toner image corresponding to signal 106. Optionally, a standard electrophoretic development process is used.

Alternatively, an electrostatographic development process, such as binary image development, as described in U.S. Pat. No. 5,436,706, U.S. Pat. No. 5,610,694, and U.S. Pat. No. 5,737,666, is used, or any other development process known in the art of laser printers is used.

Optionally, colored toner reservoirs 118 respectively hold black, cyan, yellow and magenta toner. Alternatively, for example for black and white printing, there is only one colored toner reservoir 118 which holds black toner. Or, for specialized color printing jobs, there are a different number of colored toner reservoirs 118, or there are four reservoirs with primary colored toners and one or more reservoirs with a special color or colors. There is also a toner reservoir 120 with a transparent matte toner. Optionally, there are one or more additional reservoirs with a transparent toner, for example a transparent glossy toner.

Optionally, instead of a plurality of toner reservoirs which feed into one development station, there are a plurality of development stations 116 located at different places around the circumference of cylinder 112, each with its own toner reservoir.

Optionally, instead of using photosensitive cylinder 112 to print all of the color separations (if any) for the colored toner image, as well as to print the matte "color separation" and any glossy "color separation," separate photosensitive cylinders are used for one or more of the toners. Optionally, there are also separate intermediate transfer members and impression rollers. Although this makes the printer more complicated and expensive, it may allow greater throughput, because, for example, one sheet of printing media may be printed with one toner at the same time as another sheet is being printed with another toner.

After passing development station or stations 116, the layer of toner making up the image on cylinder 112 is optionally pressed against a squeegee 122, which compresses the toner layer, squeezing out extra liquid, and producing a smooth surface. The image then optionally passes by a pre-transfer discharger 124, which discharges the surface of cylinder 112.

The image is then transferred to intermediate transfer member 126. The surface of cylinder 112 then optionally passes by a cleaning station 128, which removes any toner remaining on the surface of cylinder 112 after the image has been transferred to the intermediate transfer member. Finally, the surface of cylinder 112 optionally passes a discharger 130, which removes any charge that remains on the surface of cylinder 112 at that location. Meanwhile, as intermediate transfer member 126 rotates, it transfers the image to a printing media 132 wrapped around an impression roller 134.

The cleaned, discharged part of the cylinder surface again is charged by charger 114 when it passes under it, and part of the charge is again selectively removed by laser 110, scanning the surface and turning on and off (or modulating its intensity) according to signal 106. In the case of a color image with two or more color separations, the next color separation is applied to the surface of cylinder 112, using toner from a different one of reservoirs 118, after the first color separation has been applied, optionally leaving some space between them.

Optionally, the position of each color separation is chosen so that the different color separations will be printed on printing media 132, correctly aligned, on successive turns of impression roller 134, as photosensitive cylinder 112, intermediate transfer member 126, and impression roller 134 rotate continuously. Alternatively, one or more of these three cylinders does not rotate continuously, but stops sometimes, or reverses direction sometimes, in order to align the different color separations properly on printing media 132. Such a procedure is optionally used, for example, if the printing media is a continuous web rather than comprising individual sheets. Generally, the surfaces of those cylinders that are in contact with each other move at the same speed when they are in contact, so there is no rubbing of the toner image. Optionally, there are mechanisms for slightly separating any two of these cylinders that are normally in contact, when their surfaces are not moving at the same speed. The three cylinders need not have the same diameter or the same angular rotation rate.

Optionally, there is no intermediate transfer member, and the toner image is transferred directly from photosensitive cylinder 112 to printing media 132.

Figure 1B:
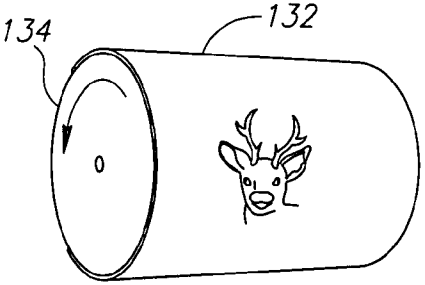
FIG. 1B is a perspective view of the printing media and part of the printer shown in FIG. 1A, with a printed image as it appears after the stage shown in FIG. 1A.

FIG. 1B shows a perspective view of impression roller 134 with printing media 132, after the image has been printed, but before matte toner has been applied. The image looks like the image displayed on monitor 104. The process as described so far is similar to a process used conventionally for printing images in a printer, and optionally the process varies in any manner known in the art of printers.

After a colored or black and white image has been printed on the printing media, an additional "color separation" is printed, using the transparent matte toner in reservoir 120. This matte "color separation" is optionally calculated by computer 102 from the image file, which specifies not only the color of each pixel in the image, but also the degree of glossiness in each pixel. For example, if printing media 132 and the colored toner image both have a glossy surface, then the matte "color separation" will specify that matte toner is to be printed on those parts of the image that are supposed to have a matte finish, and not on those parts of the image that are supposed to have a glossy finish. If part of the image is supposed to have a semi-gloss finish, then, for example, the matte "color separation" optionally specifies that alternate pixels in that part of the image have matte toner applied to them, similar to the way a gray region is created in half-tone by using black toner in alternate pixels on a white printing media.

In FIG. 2, monitor 104 displays this matte "color separation," showing which pixels will have matte toner applied to them. Optionally, for example to print a photograph with a uniform matte finish, the entire image has matte toner applied to it. Alternatively, as shown on monitor 104 in FIG. 2, one or more regions 205 do not have matte toner applied to them, but are left glossy in order to highlight them. Signals, corresponding to the matte "color separation" displayed on monitor 104, are sent from computer 102 to laser 110, exactly as signal 106 for a real color separation, or for a black and white image, was sent to laser 102 in FIG. 1A. This time, instead of development station 116 drawing toner out of colored toner reservoirs 118, transparent matte toner is drawn out of reservoir 120.

Optionally, instead of using development station 116 for all the reservoirs, each of the reservoirs, or some of the reservoirs, have their own development station adjacent to cylinder 112, for example reservoir 120 may have its own development station.

The transparent matte toner in reservoir 120 contains additive particles which are preferably larger in diameter than a wavelength of light, for example, the additive particles are larger than 1 μm in diameter. The additive particles are hard enough, and have a low enough melt flow index, or a high enough melting temperature or solvation temperature, or a high enough specific heat, that they at least partly retain their shape at the temperature of the surface of intermediate transfer member 126, when the intermediate transfer member is pressed against the printing media. Optionally, the additive particles are dispersed within larger particles made of a resin (generally a polymer), or a mixture of resins, such as those used in conventional liquid toner. As used herein, "a resin" may also refer to a mixture of resins. The polymer particles fuse and are fixed when the matte toner is printed, and cause the additive particles to adhere to the printing media.

For example, the glossiness of the surface is reduced to less than 90% of its value without the matte toner. Optionally, the glossiness is reduced to less than 70% of its value without the matte toner, or less than 50%, or less than 30%. Optionally, these figures apply at least when the glossiness of the surface without the matte toner is between 20 and 90 gloss units. Glossiness, as defined in standard T-480 om 92 from TAPPI, is a measure of the reflectivity of a surface when viewed at an angle of 75 degrees and illuminated at an angle of 75 degrees±1.5 degrees. A perfectly reflecting mirror has a glossiness of 384 gloss units, and black glass with an index of refraction of 1.54 has a glossiness of 100 gloss units.

After the printing is completed, printing media 132 is removed from impression cylinder 134. A completed print 232 is shown in FIG. 2, with the image shown in FIG. 1B, overlaid with the matte "color separation" shown on monitor 104 in FIG. 2. The matte toner covers most of print 232, except for a region 236, corresponding to region 205 displayed on monitor 104, which remains glossy.

Alternatively, the matte toner is applied to the printing media before some or all of the colored toners. If colored toner is applied in a thin enough layer over the matte toner, for example thinner than a wavelength of light, then the surface of the colored toner will have similar glossiness characteristics to the surface of the underlying matte toner. Even when the colored toner layer is not very thin, matte toner is optionally applied as an undercoat to a glossy printing media to make it match a natural matte finish of the colored toner.

Optionally, in addition to the matte toner, there is another reservoir with transparent glossy toner, and a glossy "color separation" is applied to the printing media in addition to the matte "color separation." Using both matte and glossy transparent toners may produce an image with a greater range of glossiness than using matte toner or glossy toner alone. As in the case of the matte toner, the glossy toner is optionally applied as an undercoat rather than an overcoat, particularly if the colored toner is applied in a layer thinner than a wavelength of light.

The glossy toner optionally comprises colorless polymer toner particles which have a higher melt flow index, or are softer, than the toner particles in the other toners, so that they produce a surface that is smoother when they have been heated and pressed than ordinary toner. Optionally there are more than two colorless "toners" which each produce a different degree of glossiness. However, intermediate levels of glossiness are also optionally produced by applying the glossy toner to only some pixels in a region, and applying the matte toner to other pixels, and/or not applying any colorless "toner" to other pixels. Different levels of glossiness are also optionally produced by printing multiple layers of the matte toner or the glossy toner.

In an embodiment of the invention, the matte toner used as an overcoat is substantially colorless. Substantially colorless toner has no colorant, or may have residual colorant at a low enough level so that any difference between areas printed with the matte toner and the background, due to the colorant, is much less noticeable, to an typical viewer in typical lighting conditions, than the difference in glossiness.

Matte liquid toner optionally comprises a carrier liquid, with substantially colorless polymer toner particles suspended in it. Alternatively, the polymer toner particles do include some pigment, for example to provide some special effect, but optionally the toner particles have a low enough level of pigment so that the printed toner layer is transparent or at least translucent. The carrier liquid is optionally of the same composition as that used in conventional colored toners, for example at least 80% a liquid hydrocarbon such as Isopar L (Exxon). Dispersed within the toner particles of the matte toner are additive particles, smaller than the toner particles but also with diameter optionally greater than or comparable to a wavelength of light, and with melting point and solvation point sufficiently high so that the additive particles do not melt when the image is produced and printed. Optionally, the additive particles are hard, and retain their shape during the printing process. Additionally or alternatively, soft elastic particles such as cross-linked PMMA are used, or a polymer additive is used which is not compatible with the toner polymer. In all of these cases, the printed surface may end up with a rough surface on a scale greater than a wavelength of light, and hence has a matte finish.

Optionally, the additive particles comprise more than 5% of the total weight of the polymer toner particles. Optionally, the additive particles comprise between 5% and 10% of the weight of the polymer toner particles, or between 10% and 20% of the weight, or between 20% and 30% of the weight, or between 30% and 40% of the weight, or about 40% of the weight, or more than 40%. The optimum percentage of additive particles in the toner particles of the matte toner involves some trade-offs. For example, having a higher percentage of additive particles in the toner particles has the advantage that the printed matte toner layer has a lower degree of glossiness. But a lower percentage of additive particles has the potential advantages that the printed layer may have greater strength and be less likely to crack, peel, or flake. A lower level of additive particles may also be more likely to be transparent enough so that an underlying image is fully visible, and in general may lead to a better overall print quality. A toner with a lower percentage of additive particles may also be easier to manufacture, and less likely to scratch or damage the photosensitive cylinder, the intermediate transfer member, and the printed image.

Optionally, the quantity of additive particles in the matte toner is adjusted up or down, in order to produce a different level of glossiness. Generally, using a larger quantity of additive particles results in a matte toner which produces a lower level of glossiness on the printed image.

Optionally, the additive particles have an average diameter of about 3 micrometers, which is sufficiently greater than a wavelength of light that the degree of glossiness of the printed surface will not be noticeably wavelength-dependent. Alternatively, the additive particles have an average diameter between 1 and 3 micrometers, or between 3 and 5 micrometers, or between 5 and 10 micrometers, or between 10 and 15 micrometers, or greater than 15 micrometers.

The glossy toner also comprises a carrier liquid with substantially colorless polymer toner particles suspended in it, but the toner particles optionally have a higher melt flow index than for the colored toner, so that the particles melt and form a smoother surface on the scale of a wavelength of light, when the image is printed. (Melt flow index or MFI is measured in decigrams of flow per minute, at 190 C, with the material pushed by a weight of 2.16 kg, in a configuration as described in ASTM standard D-1238.) For example, in the glossy toner, the polymer has melt flow index ranging from 100 to as high as 1300, with typical values of 200 to 500, while for conventional toner the polymer typically has a melt flow index between 35 and 100, and for matte toner the melt flow index ranges between 3 and 100. Alternatively or additionally, the glossy toner has additives which increase the gloss and/or prevent peeling. As noted above for the matte toner, the glossy toner also alternatively has some pigment in the toner particles, to produce special effects, but optionally is transparent, or at least translucent.

In accordance with an exemplary embodiment of the invention, the matte toner is manufactured by the following procedure. In a Ross mixer, a varnish is first prepared by mixing one or two different resins as a 20% to 30% solution in Isopar-L. The resins are optionally chosen from the following list: Nucrel 699, Nucrel 903, Nucrel 403, Bynel 2022, Bynell 2014, Bynell 2002, Lotader AX8840, and Lotader AX8900. Nucrel (ethylene acrylic acid and methacrylic acid copolymer resin) and Bynel (acid-modified ethylene acrylate copolymer resin) are made by Dupont, and Lotader is made by Atofina. Lotader AX8840 is a copolymer of ethylene and glycidyl methacrylate (E-GMA), while Lotader AX8900 is a terpolymer of ethylene, methyl acrylate, and glycidyl methacrylate (E-MA-GMA). Of these resins, Nucrel 699, with a melt flow index of 100, and Bynel 2022, with a melt flow index of 35, are also used in conventional liquid toner. The other resins listed have much lower melt flow index, between 3 and 10. The solution is heated to 160 C and mixed for one to two hours, and is then allowed to cool to room temperature while mixing for two to six hours.

Aluminium tristearate and other additives (for example additive particles) are then optionally added to the varnish. The aluminium tristearate comprises typically 1%, and up to 3%, of the total solids (resins plus additives), and the additive particles comprise up to 50% of the total solids. Optionally, not all of the additive particles are added at this time, but some of them are added now, for example 20% of the total solids, and the rest are added later. Optionally, the additive particles comprise one or more of the following materials: Teflon (PTFE), polytetrafluoroethylene wax, polyethylene wax, cross linked poly-methyl-methacrylate (PMMA), cross linked poly-methyl-butylacrylate, cross linked poly-acrylacrylate, silica, kaolin, calcium carbonate, aluminium silicate, nepheline syenite, and microcrystalline silica (which may contain: silicon dioxide, iron oxide, aluminium oxide, calcium oxide, titanium dioxide, magnesium oxide, potassium oxide, sodium oxide). Ethylene vinyl acetate copolymer (sold by Honeywell as AC-400A), and propylene maleic anhydride copolymer (Honeywell's AC-597), are examples of additives which produce a matte finish because they are incompatible with the toner polymer. The additive particles are also used in some conventional (colored) liquid toners made by Hewlett Packard, and optionally in the glossy toner, but in smaller quantities, typically only 3% by weight of the total solids, to improve durability.

The varnish plus additives is optionally diluted with Isopar-L to a 15% to 30% solid concentration, and a quantity with 100 grams of solids is placed in a one gallon attritor, where it is ground for 4 to 20 hours, using 3/16" diameter steel balls, at a temperature typically of 45 C, but optionally as low as room temperature (20 C). The rest of the additive particles, if any, are then added to the mixture, as well as, optionally, Marcol 82, in an amount of 1% by weight of the liquid, polydimethysiloxane trimethylsiloxy terminated 300,000 cSt (sold by ABCR as DMS-T53), in an amount of 0.0085% by weight of the liquid, and a two component silicon gel, comprising 4%-8% dimethicone/vinyl dimethicone crosspolymer and 92%-96% cyclopentasiloxane (the gel sold by ShinEtsu as KSG-15), in an amount of 0.00051% by weight of the liquid.

In accordance with an exemplary embodiment of the invention, the glossy toner is manufactured by a similar process, but with the following differences. Up to three different resins are used, with one of the resins optionally comprising at least 50% of the total resins, and they are optionally chosen from the following list: Nucrel 699, Nucrel 599, Nucrel 2940, Lotader 8200, Primacor 5980I, Primacor 5990I, and A-C 5120. Primacor is made by Dow, and A-C 5120 is made by Honeywell, both being commercial names for ethylene acrylic acid copolymer resin. Lotader 8200 consists of ethylene, ethyl acrylate, and maleic anhydride terpolymer. Although Nucrel 699, with a melt flow index of 100, is also optionally used in matte toner and conventional toners, the other resins on this list have higher melt flow index, ranging from 200 to 500, and, in the case of Primacor 5990I, as high as 1300. Optionally, smaller quantities of the resins listed for the matte toner are also used in the glossy toner, in order to make the printed layer thinner and reduce cracking.

The additive particles used in the matte toner, if they are used at all in the glossy toner, are limited to smaller quantities than in the matte toner, for example 3% by weight of the total solids. Other additives are optionally added to the glossy toner, either in the varnish stage or in the grinding stage, to make it more glossy, or to prevent peeling. These additives include Laropal K80 (condensation product of cylcohexanone, made by BASF), Laropal A81 (condensation product of urea and aldehydes), Bremar 7080 (cyclohexanone resin, made by Kraemer), and Bremar 7110 cyclohexanone-formaldehyde resin). The glossy toner is optionally ground for 10 to 20 hours.

The invention has been described in the context of the best mode for carrying it out. It should be understood that not all features shown in the drawing or described in the associated text may be present in an actual device, in accordance with some embodiments of the invention. Furthermore, variations on the method and apparatus shown are included within the scope of the invention, which is limited only by the claims. Also, features of one embodiment may be provided in conjunction with features of a different embodiment of the invention. As used herein, the terms "have", "include" and "comprise" or their conjugates mean "including but not limited to." As used herein, "colored" toner includes black toner, or white toner for printing on non-white printing media, but excludes colorless toner.

The invention claimed is:

1. A matte liquid toner suitable for use in a liquid toner printer, comprising:

a) a carrier liquid;

b) toner particles comprising a resin; and c) substantially uncolored additive particles of average diameter between 1 and 20 micrometers dispersed in the resin, wherein the additive particles make up at least 10% by weight of the toner particles, and comprise one or more of PTFE (teflon), PTFE wax, polyethylene wax, cross-linked poly-methyl-methacrylate, cross-linked poly-methyl-butylacrylate, and cross-linked poly-acryl-acrylate, and said additive particles do not melt or solvate at a surface temperature of an intermediate transfer member during printing, when said matte liquid toner is used for printing in said liquid toner printer.

2. The matte toner according to claim 1, wherein the additive particles make up between 10% and 20% by weight of the toner particles.

3. The matte toner according to claim 1, wherein the additive particles make up between 20% and 40% by weight of the toner particles.

4. The matte toner according to claim 1, wherein the additive particles comprise up to 50% by weight of the toner particles.

5. The matte toner according to claim 1, wherein the resin comprises at least one thermoplastic resin.

6. The matte toner according to claim 5, wherein at least one of the at least one thermoplastic resin has a melt flow index less than or equal to 100.

7. The matte toner according to claim 5, wherein said thermoplastic resin has a melt flow index less than 35.

8. The matte toner according to claim 1, wherein said PTFE (teflon), PTFE wax, polyethylene wax, cross-linked poly-methyl-methacrylate, cross-linked poly-methyl-butylacrylate, or cross-linked poly-acryl-acrylate is incompatible with said resin.

9. The matte toner according to claim 1, wherein the average diameter of the additive particles is between 1 and 3 micrometers.

10. The matte toner according to claim 1, wherein the average diameter of the additive particles is between 3 and 8 micrometers.

11. The matte toner according to claim 1, wherein the average diameter of the additive particles is between 8 and 20 micrometers.

12. The matte toner according to claim 1, wherein said resin solvates and is plasticized by the carrier liquid.

13. The matte toner according to claim 1, wherein the additive particles comprise one or more of PTFE (teflon), PTFE wax, and polyethylene wax.

14. The matte toner according to claim 1, wherein the additive particles comprise one or more of cross-linked poly-methyl-methacrylate, cross-linked poly-methyl-butylacrylate, and cross-linked poly-acryl-acrylate.

15. A printer for printing both matte and glossy images on a same grade of printing media, comprising: a) at least one reservoir holding colored toner; b) a reservoir holding a substantially uncolored matte toner according to claim 1; and c) a printing engine which applies toner from at least one of the at least one colored toner reservoirs to the printing media, thereby producing the images from the colored toner, and selectively applies the matte toner to some of said printing media, thereby making some of the images matte images.

16. A printer according to claim 15, and including a reservoir holding an extra glossy toner, wherein the printing engine also selectively applies the extra glossy toner to some of the printing media, thereby producing the glossy images.

17. A printer according to claim 15, wherein the printing engine is configured to selectively apply the matte toner to only one portion of the printing media, thereby producing images that have different degrees of glossiness in different areas thereof.

18. A printer according to claim 15, comprising a controller which controls the selective application of the matte toner to the printing media, thereby controlling the glossiness of at least a portion of each image.

19. A printer according to claim 15, wherein the image comprises a plurality of pixels, and the print engine applies the matte toner to different fractions of the pixels to produce different degrees of glossiness.

20. A printer according to claim 15, wherein the print engine applies the matte toner to at least some of the printing media more than once, and applies different numbers of layers of the matte toner to produce different degrees of glossiness.

* * * * *